US007077934B2

(12) United States Patent
Kolassa et al.

(10) Patent No.: US 7,077,934 B2
(45) Date of Patent: Jul. 18, 2006

(54) METHOD FOR FILLING A HORIZONTAL FLUE COKING OVEN

(75) Inventors: Oliver Kolassa, Bochum (DE); Franz-Josef Schücker, Castrop-Rauxel (DE); Claus-Jürgen Bast, Düsseldorf (DE); Jan Scholten, Essen (DE); Anatoly Polyakov, Essen (DE)

(73) Assignee: Uhde GmbH, Dortmund (DE)

( * ) Notice: Subject to any disclaimer, the term of this patent is extended or adjusted under 35 U.S.C. 154(b) by 18 days.

(21) Appl. No.: 10/520,442

(22) PCT Filed: Jun. 12, 2003

(86) PCT No.: PCT/EP03/06154

§ 371 (c)(1),
(2), (4) Date: Jan. 6, 2005

(87) PCT Pub. No.: WO2004/007640

PCT Pub. Date: Jan. 22, 2004

(65) Prior Publication Data

US 2005/0217987 A1 Oct. 6, 2005

(30) Foreign Application Priority Data

Jul. 16, 2002 (DE) ..... 102 32 279

(51) Int. Cl.
*C10B 31/00* (2006.01)

(52) U.S. Cl. ..... 201/40

(58) Field of Classification Search ..... 202/239, 202/247, 262, 270, 133, 145; 201/40
See application file for complete search history.

(56) References Cited

FOREIGN PATENT DOCUMENTS

| | | |
|---|---|---|
| DE | 976 745 | 4/1964 |
| DE | 118 671 | 3/1976 |
| FR | 897 676 | 3/1945 |

*Primary Examiner*—Glenn Caldarola
*Assistant Examiner*—Alexis Wachtel
(74) *Attorney, Agent, or Firm*—Collard & Roe, P.C.

(57) ABSTRACT

The invention relates to a method for filling a horizontal flue coking oven. According to the invention, spinning cells are introduced into the furnace chamber for filling, which comprise a discharge element rotating about a vertical axis. The bulk material is charged onto the spinning cells and the bulk material distributed in the furnace chamber as a result of the rotation of the discharge element. The surface of the bulk material is subjected to a subsequent raking process.

4 Claims, 1 Drawing Sheet

METHOD FOR FILLING A HORIZONTAL FLUE COKING OVEN

CROSS REFERENCE TO RELATED APPLICATIONS

Figure 1:
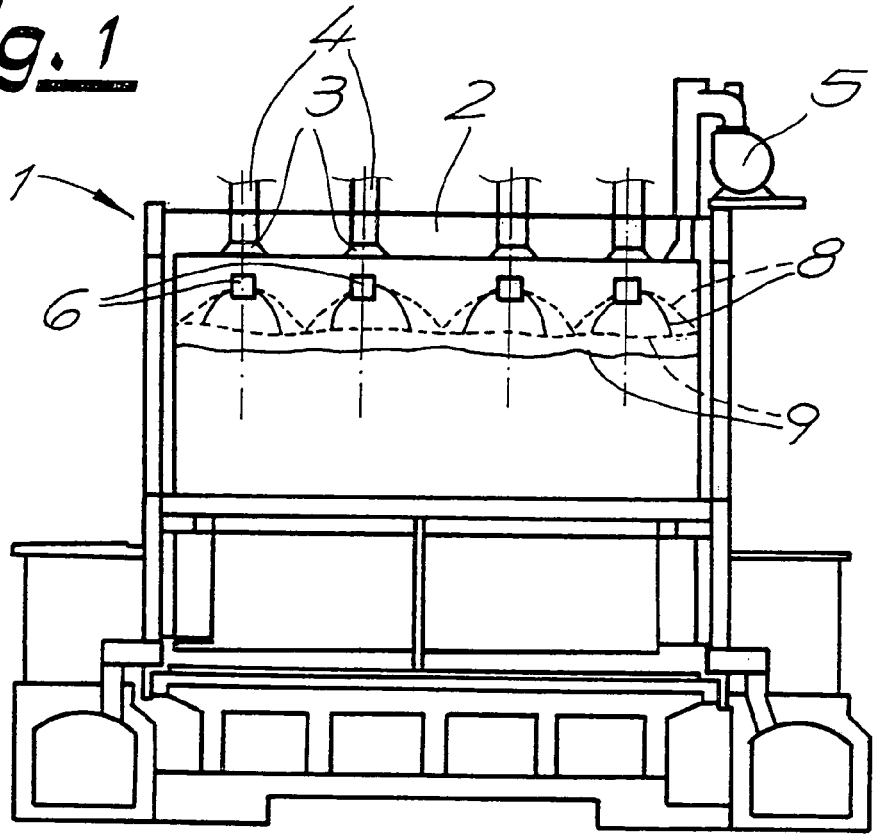

Applicants claim priority under 35 U.S.C. §119 of Application No. DE 102 32 279.1 filed Jul. 16, 2002. Applicants also claim priority under 35 U.S.C. §365 of PCT/EP2003/006154 filed Jun. 12, 2003. The international application under PCT article 21(2) was not published in English.

The invention relates to a method for filing a horizontal flue coking oven, wherein spinning cells are introduced into the furnace chamber, which comprise a discharge element rotating about a vertical axis, and wherein the bulk material is charged onto the spinning cells, which distribute the bulk material in the oven chamber by means of rotation of their discharge element.

For filling oven chambers of a horizontal flue coking oven, coal filling carts are used, which travel along the oven ceiling and have discharge devices having transport screws as well as filling telescopes. The filling telescopes are lowered onto filling openings in the oven ceiling, in order to fill an oven chamber. The coal passes through the filling telescopes and the filling openings into the oven chamber, whereby defined cones of bulk material form below the filling openings. The cones of bulk material are leveled using a leveling rod that is introduced into the oven chamber through a side oven door. Leveling of the surface of the bulk material is supposed to ensure that filling gases that develop, to a great extent, towards the end of the filling process, flow out of the oven chamber towards a venting opening and can be passed into a collecting main. However, leveling of the surface of the bulk material is not free of disadvantages. During leveling, the gas collection space above the surface of the bulk material is reduced by the leveling rod.

This worsens the gas venting, so that emissions can occur to a greater extent during this phase. Furthermore, the cycle times are lengthened as a result of the leveling process, since the coal filling cart and the leveling device work in close connection with one another, so that the coal filling cart waits at the oven chamber to be filled, until the leveling process has been completed.

A method having the characteristics described initially is known from the references FR 897 676 A as well as DE 976 745 C. In the case of the device known from FR 897 676 A. the discharge element is attached to a rotating telescope arm that is moved into the oven chamber, and the extension length of which can be adapted to the filling level in the oven chamber. It is true that in comparison with simply filling in coal, the formation of a cone of bulk material as described is reduced, but it is not completely avoided. Therefore, unhindered venting of gas is not always guaranteed with the known method, either.

From the reference DD 118 671 A, a method for filling a horizontal flue coking oven is known, wherein coal is introduced into the oven chamber from the top, using a rotating shovel wheel. The shovel wheel transports the coal into a spinning tube that is configured to be elastic, so that its inclination relative to the vertical can be adjusted, in order to achieve as uniform as possible a distribution of the coal during the filling process. However, the problems described are not satisfactorily solved with these measures, either.

The invention is based on the task of indicating a method for filling a horizontal flue coking oven in which no cones of bulk material that prevent gas venting are formed below the filling openings.

Proceeding from a method having the characteristics described initially, the task is accomplished, according to the invention, in that in order to obtain as uniform as possible a surface of the bulk material, the speed of rotation of the discharge elements is controlled during the filling process, and is increased with an increasing filling level of the oven, so that flatter flight oaths of the coal particles are obtained. Spinning cells are understood to be devices that are charged from the top with coal, during filling of the oven chamber, and comprise discharge elements that are driven to rotate, which elements elect the coal by means of their rotational movement. Scattering plates and/or throwing shovels can be used as the discharge elements. The filling progression and the flight path of the coal particles can be changed by means of the design of the discharge elements, as well as by means of varying their speed of rotation.

This task is accomplished, according to the invention, in that spinning cells are introduced into the furnace chamber, which comprise a discharge element rotating about a vertical axis, and that the bulk material is charged onto the spinning cells, which distribute the bulk material in the oven chamber by means of rotation of their discharge element. Spinning cells are understood, according to the invention, to be devices that are charged from the top with coal, during filling of the oven chamber, and comprise discharge elements that are driven to rotate, which elements eject the coal by means of their rotational movement. Scattering plates and/or throwing shovels can be used as the discharge elements.

A horizontal flue coking oven has narrow and elongated oven chambers. According to a preferred embodiment of the invention, spinning cells having lateral guide baffles are used, which delimit the exit region. The spinning cells can be structured in such a manner that the coal particles exit from the spinning cells with flat, far-reaching flight paths, in the one direction, while the flight paths in the crosswise direction to that are limited to a nearby region, by means of the guide baffles.

According to a preferred embodiment of the invention, the spinning cells are introduced into the oven chamber through filling openings in the oven ceiling, before the oven is filled, and are retracted through the filling openings after the oven has been filled.

In the following, the invention will be explained using a drawing that represents an embodiment only as an example. It schematically shows FIG. 1 a cross-section through an oven chamber of a horizontal flue coking oven while it is being filled with coal, FIG. 2 a spinning cell used for filling.

The oven chamber of a horizontal flue coking oven 1, shown in FIG. 1, has an oven ceiling 2 that contains filling openings 3 that can be closed. Coal gets into the oven chamber through filling telescopes 4 that are lowered to the opened filling openings 3. Furthermore, a venting device 5 for filling gases is arranged in the oven ceiling 2.

Before the oven is filled, spinning cells 6 are introduced into the oven chamber through the filling openings 3 or other openings in the oven ceiling 2, which cells have a discharge element 7 driven to rotate about a vertical axis. The bulk material that is supplied from the filling telescopes 4 is charged onto the spinning cells 6, which distribute the bulk material in the oven chamber by means of rotation of their discharge element 7. The filling progression and the flight path of the coal particles can be changed by means of the design of the discharge elements 7 as well as by means of varying their speed of rotation. FIG. 1 schematically shows flight paths 8 for different speeds of rotation. The speed of rotation of the discharge elements 7 can be controlled during the filling process, in order to change the flight path of the bulk material ejected from the spinning cells 6, in such a manner that as uniform as possible a surface 9 of the bulk material is obtained. It is practical if the speed of rotation of the discharge elements 7 increased as the oven is filled, so that flatter flight paths 8 of the coal particles are obtained.

Figure 2:
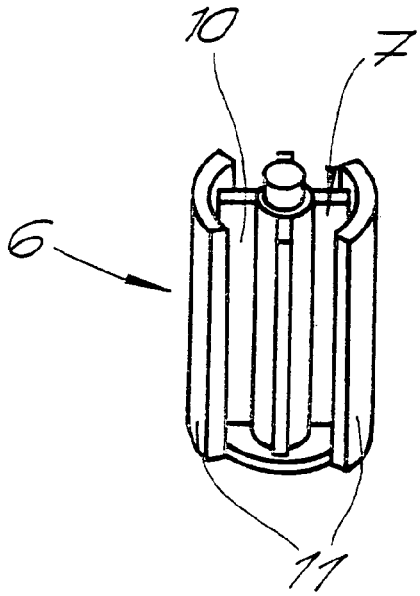

Spinning cells 6 are understood to be devices according to the invention that are charged with coal from the top, during filling of the oven chamber, and have a rotating discharge element 7 that ejects the coal particles. Scattering plates and/or throwing shovels can be used as the discharge elements 7. FIG. 2 shows the fundamental structure of a spinning cell 6 that is suitable for the method described. As the discharge element 7, it has a rotor that can be driven to rotate about a vertical axis, having throwing shovels 10. Furthermore, lateral guide baffles 11 are provided in the exemplary embodiment, which limit the throwing angle. The drive of the rotor takes place with a motor, not shown, which is connected with the discharge element 7 by means of a coupling shaft that is brought up to the oven chamber, for example.

Using the method described, i.e. using the device described, it is possible to fill oven chambers of a horizontal flue coking oven in such a manner that no disruptive cones of bulk material, which prevent passing the filling gases out of the oven chamber, are formed. According to the invention, a leveling process of the surface of the bulk material is eliminated.

The invention claimed is:

1. Method for filling a horizontal flue coking oven, wherein spinning cells (6) are introduced into the furnace chamber, which comprise a discharge element (7) rotating about a vertical axis, and wherein the bulk material is charged onto the spinning cells (6), which distribute the bulk material in the oven chamber by means of rotation of their discharge element (7), wherein in order to obtain as uniform as possible a surface of the bulk material, the speed of rotation of the discharge elements (7) is controlled during the filling process, and is increased with an increasing filling level of the oven, so that flatter flight paths of the coal particles are obtained.

2. Method as claimed in claim 1, wherein the spinning cells (6) are introduced into the oven chamber through filling openings (3) in the oven ceiling (2), before the oven is filled, and are retracted through the filling openings (3) after the oven has been filled.

3. Method as claimed in claim 1 wherein scattering plates and/or throwing shovels (10) are used as discharge elements (7).

4. Method as claimed in claim 1, wherein spinning cells (6) with lateral guide baffles (11) are used, which limit the exit region.

* * * * *